US009932801B2

(12) United States Patent
Raffn

(10) Patent No.: US 9,932,801 B2
(45) Date of Patent: Apr. 3, 2018

(54) METHOD FOR STABILIZING A CAVITY IN A WELL

(71) Applicant: NORWAY WELL SOLUTIONS AS, Sandnes (NO)

(72) Inventor: Anne Gerd Raffn, Sandnes (NO)

(73) Assignee: NORWAY WELL SOLUTIONS AS, Sandnes (NO)

( * ) Notice: Subject to any disclaimer, the term of this patent is extended or adjusted under 35 U.S.C. 154(b) by 226 days.

(21) Appl. No.: 14/761,869

(22) PCT Filed: Jan. 13, 2014

(86) PCT No.: PCT/NO2014/050005

§ 371 (c)(1),
(2) Date: Jul. 17, 2015

(87) PCT Pub. No.: WO2014/112881

PCT Pub. Date: Jul. 24, 2014

(65) Prior Publication Data

US 2015/0369019 A1 Dec. 24, 2015

(30) Foreign Application Priority Data

Jan. 18, 2013 (NO) ..... 20130116

(51) Int. Cl.
*E21B 43/04* (2006.01)
*E21B 33/138* (2006.01)

(52) U.S. Cl.
CPC ..... *E21B 43/04* (2013.01); *E21B 33/138* (2013.01)

(58) Field of Classification Search
CPC ..... E21B 43/04
See application file for complete search history.

(56) References Cited

U.S. PATENT DOCUMENTS 3,011,548 A 12/1961 Holt
3,967,682 A 7/1976 Stein et al.
5,195,583 A 3/1993 Toon et al.
(Continued)

FOREIGN PATENT DOCUMENTS

EP 2143874 A1 1/2010

OTHER PUBLICATIONS

International Patent Application No. PCT/NO2014/050005 International Search Report and Written Opinion dated Apr. 11, 2014 (8 pages).

*Primary Examiner* — Robert E Fuller
(74) *Attorney, Agent, or Firm* — Conley Rose, P.C.

(57) ABSTRACT

A method for stabilizing a cavity at a production or injection zone in an underground well includes providing a filtering element in the well at the cavity that is to be stabilized. The filtering element is formed with openings. The method further includes injecting a first fluid including expandable particles through the filtering element into the cavity. The expandable particles have a non-expanded state with a diameter smaller than the diameter of the openings of the filtering element. The method further includes injecting a second fluid through the filtering element. The second fluid is configured to react with the expandable particles such that the expandable particles expand to a diameter larger than the diameter of the openings in the filtering element, whereby the expanded particles and the filtering element form a filter at the production or injection zone in the well.

18 Claims, 2 Drawing Sheets

(56) References Cited

U.S. PATENT DOCUMENTS

| | | | | |
|---|---|---|---|---|
| 5,253,709 | A | 10/1993 | Kendrick et al. | |
| 2003/0075342 | A1 | 4/2003 | Gunnarsson | |
| 2004/0020662 | A1 | 2/2004 | Freyer | |
| 2007/0044963 | A1* | 3/2007 | MacDougall | E21B 33/13 166/278 |
| 2007/0221387 | A1 | 9/2007 | Levy | |
| 2009/0173497 | A1 | 7/2009 | Dusterhoft | |
| 2009/0255691 | A1 | 10/2009 | Loughlin et al. | |
| 2010/0065271 | A1* | 3/2010 | McCrary | C09K 8/805 166/278 |
| 2011/0247812 | A1* | 10/2011 | Panga | C09K 8/56 166/278 |

* cited by examiner

METHOD FOR STABILIZING A CAVITY IN A WELL

CROSS REFERENCE TO RELATED APPLICATIONS

This application is a 35 U.S.C. § 371 national stage application of PCT/NO2014/050005 filed Jan. 13, 2014, which claims the benefit of Norwegian Patent Application No. 20130116 filed Jan. 18, 2013, each of which is hereby incorporated herein by reference in its entirety for all purposes.

BACKGROUND

The present disclosure relates to a method for stabilizing a cavity in a well.

Stabilizing open annuli in production and injection wells helps avoid sand production. Today, this is usually done by gravel packing Gravel and/or sand is packed around a sand screen or a perforated casing to function as a sieve by preventing finer sand from the formation from being carried in the petroleum into the well. Another alternative has been to stabilize formation sand by supplying resinous materials to "glue" the formation together.

During gravel packing, there is a substantial risk of failure when placing the sand/gravel pack, especially in long horizontal wells. It may be challenging to place sand and gravel packs in production and injection wells in which packers divide the annulus along the well path into several production or injection intervals. In addition, stabilizing the annulus for several production or injection intervals can be difficult when there are inflow or outflow valves along the well path, and different pressure conditions in the different formations that divide the well into several zones. Today, casing is cemented and perforated and cannot be completed with sand screens in the entire production or injection interval. Further, it is only the lowermost part of the well that is gravel packed. There is also a substantial risk of erosion on pipes and equipment in the well if the sand/gravel pack leaks through the sand screen or a perforated casing. If the annulus is closed naturally by the formation sand in one or more places along the well path, the entire well length cannot be sand/gravel packed in a satisfactory manner, and the gravel packing will be incomplete. When the formation sand is glued, it is then fractured to enable production. This method is time-consuming and the directions of the fracture systems are not predictable. Thus, a risk arises that the well does not produce/inject in the right formation intervals. In sum, the known methods are generally expensive, complicated and not very flexible.

BRIEF SUMMARY OF THE DISCLOSURE

The invention relates, more specifically, to a method for stabilizing a cavity at a production or injection zone in an underground well, the method includes providing a filtering element in the well at the cavity that is to be stabilized with the filtering element being formed with openings. The method further includes injecting a first fluid including expandable particles through the filtering element into the cavity, where the expandable particles when in their non-expanded state, have a diameter smaller than the diameter of the openings of the filtering element. The method further includes injecting a second fluid through the filtering element, the second fluid being configured to react with the expandable particles such that the expandable particles expand to a diameter larger than the diameter of the openings in the filtering element. In addition, the expanded particles and the filtering element form a filter at the production or injection zone in the well.

In one embodiment, injecting a first fluid including expandable particles through the filtering element in to the cavity and injecting a second fluid through the filtering element may include injecting the first and/or second fluid(s) through a fluid-carrying string. In an alternative embodiment, the fluids may be pumped down into the well from the wellbore opening.

The cavity to be stabilized may include various types of cavities, annuli and formation fractures in an underground well.

The expanded particles may, thus, function as a filter together with a filtering element such as a sand screen and/or a perforated casing or an inflow control device or an outflow control device.

The expandable particles may, for example, include an elastomer. The particles may further include one or more layers of organic and/or inorganic materials. It is known that some elastomers can expand on contact with hydrocarbon-containing fluids and/or with water containing various added chemicals. The second fluid may, thus, be a fluid including hydrocarbons and/or water.

In one embodiment, the method may include injecting a mixture of expandable and porous particles. This may be beneficial if the expandable particles when expanded, attach to each other and thereby do not allow sufficient flow through the expanded particles. The porous particles may, for example, be taken from a group including: macroporous silica, macroporous carbon, macroporous polymer particles, volcanic rocks, for example pumice, diatomite (diatomaceous earth), zeolites, sintered ceramic materials and sintered metallic materials.

In one embodiment, the method may, as an alternative or in addition, include injecting a mixture of expandable particles and non-porous particles like glass spheres, polymer spheres and mineral particles. The non-porous particles may prevent the expandable particles from attaching to each other such that at least a portion of the flow is obstructed.

The above-mentioned particles, both porous and non-porous, may have a diameter smaller than the diameter of the filtering element. After expansion of the expandable particles, said porous and non-porous particles become locked into the mixture so that they will not escape back out through the openings in the filtering element, in spite of their size.

The openings in the filtering element and the expandable particles may have diameters in the micrometer range. The final composition of expandable particles and any porous or non-porous materials allows a flow of hydrocarbons through the filter, that is to say through the expanded particles and the filtering element, into or out of the well.

The method may further, before injecting a first fluid including expandable particles through the filtering element in to the cavity, include setting one or more packers sealingly around the fluid-carrying string within a casing in the well. This may be employed to isolate the annulus outside the fluid-carrying string so that the expandable particles are carried towards the cavity which is to be stabilized and will not flow up the annulus around the fluid-carrying string.

The filtering element may include one or more filtering elements. It may be, for example, a casing with perforations and/or slots. In addition, the filtering element may include a filtering element placed on the outside of the casing. The filtering element on the outside of the casing may be any filtering element known in the art including, but not limited to, a sand screen.

Compared with the above-mentioned known methods for stabilizing a cavity at a production or injection zone in an underground well, the present disclosure provides a simplified method that will save time and provide increased flexibility. The embodiments of the present disclosure will also enable annulus-packing of a variety of production or injection intervals along the well path. In addition, annulus-packing will be possible independently of local pressure conditions in the well. Annulus-packing will be possible in long horizontal wells, wells with inflow and outflow valves and multilateral wells. The present disclosure will also reduce the risk of erosion in/on pipes and equipment in the well.

BRIEF DESCRIPTION OF THE DRAWINGS

For a detailed description of the exemplary embodiment of the disclosure, reference will now be made to the accompanying drawings in which.

DETAILED DESCRIPTION OF DISCLOSED EXEMPLARY EMBODIMENTS

Figure 1:
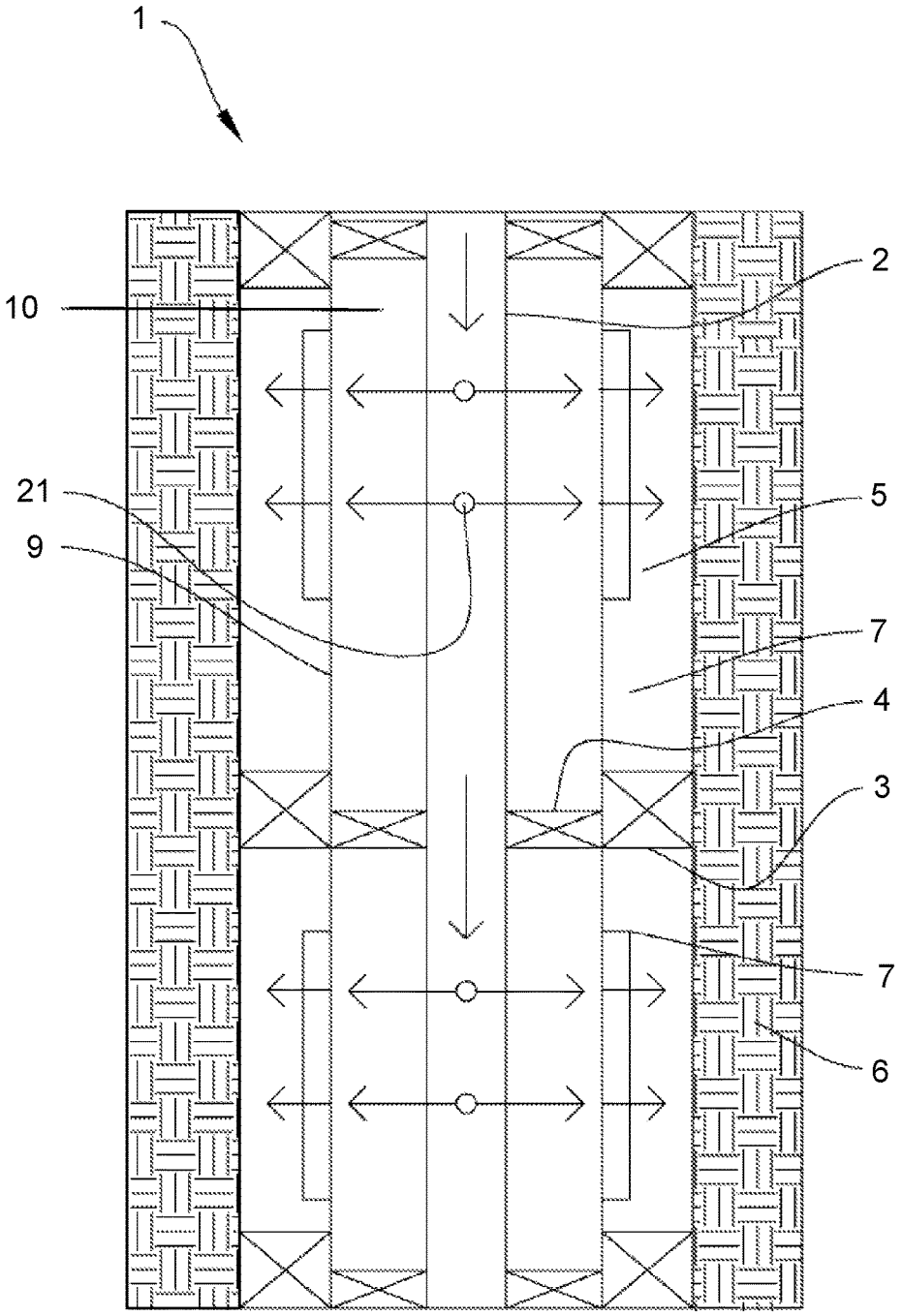
FIG. 1 shows a well as used in an embodiment of the present disclosure, in a side view.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosures, including the claims, is limited to that embodiment.

The drawing figures are not necessarily to scale. Certain features of the embodiments disclosed herein may be shown exaggerated in scale or in somewhat schematic form, and some details of conventional elements may not be shown in the interest of clarity and conciseness.

In what follows, the reference numeral 1 indicates a well as used in the method of the present disclosure. The figures are shown in a simplified and schematic manner, and like reference numerals indicate like or corresponding elements. A fluid-carrying string 2 extends down into the well 1 the well 1 being cased in the portion shown, with a casing 9. In some portions, the casing 9 is provided with sand screens 7. A cavity in the form of an annulus 5 outside the casing 9 is provided with permanent packer elements 3. Packer elements 4 are used to seal an annulus 10 between the fluid-carrying string 2 and the casing 9. The packer elements 4 may be temporary or permanent. A fluid, not shown, including expandable particles 8 (see FIG. 2) is carried down the fluid-carrying string 2, into the annulus 10 between the fluid-carrying string 2 and the casing 9 via openings 21 in the fluid-carrying string 2. The fluid including expandable particles 8 then passes through perforations, not shown, in the casing 9, through the sand screen 7 and into the annulus 5 between the casing 9 and a formation 6 as indicated by arrows in FIG. 1.

Another fluid, not shown, is then carried through the fluid-carrying string 2 and out to the expandable particles 8 in the annulus 5. The expandable particles 8 expand to a diameter larger than the diameter of openings in the sand screen 7 (see FIG. 2) so the expanded particles 8 cannot escape back into the annulus 10 between the fluid-carrying string 2 and the casing 9. Thus, the expanded particles 8 together with the sand screen 7 form a filter that prevents undesired sand production in the well 1 while allowing the production of hydrocarbons or injection of water and supporting the formation 6.

Figure 2:
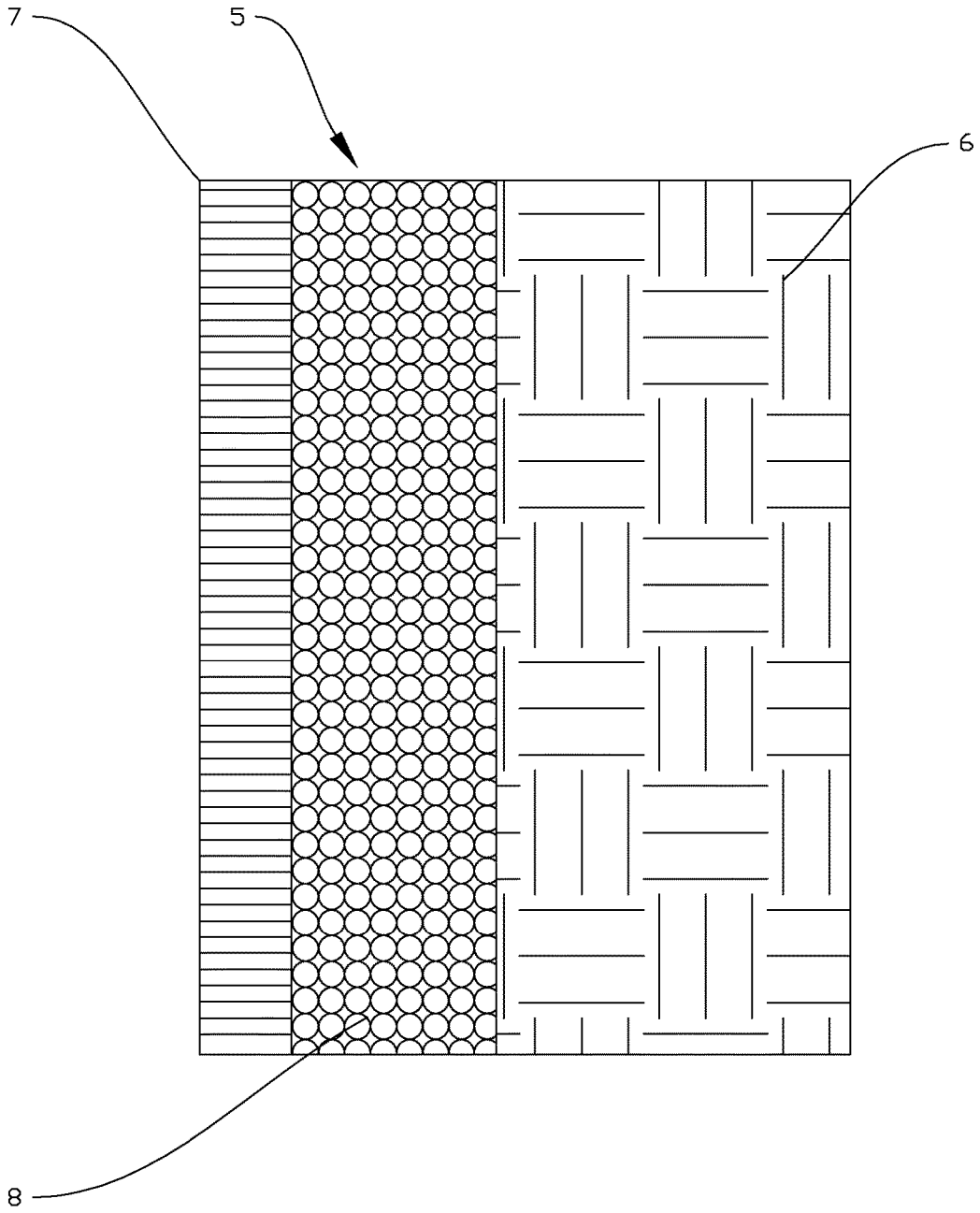
FIG. 2 shows a portion of a well as used in the present disclosure, in a side view and on a larger scale than FIG. 1.

FIG. 2 shows an enlarged portion of the annulus 5 after the expandable particles 8 have been injected through the sand screen 7 and expanded to a diameter larger than the diameter of openings in the sand screen 7.

The invention claimed is:

1. A method for stabilizing an annulus at a production or injection zone in an underground well, the method comprising:

providing a filtering element in the well at the annulus to be stabilized, the filtering element being formed with openings, wherein each opening has a diameter;

injecting a first fluid including expandable particles through the filtering element into the annulus, the expandable particles, when in their non-expanded state, having a diameter smaller than the diameter of the openings of the filtering element; and injecting a second fluid through the filtering element, the second fluid being configured to react with the expandable particles in such a way that the expandable particles are expanded to a diameter larger than the diameter of the openings in the filtering element, whereby the expanded expandable particles and the filtering element form a filter at the production or injection zone in the well.

2. The method in accordance with claim 1, further comprising injecting the first and second fluids through a fluid-carrying string.

3. The method in accordance with claim 2, further comprising setting one or more packer elements sealingly around the fluid-carrying string.

4. The method in accordance with claim 3, wherein the second fluid includes hydrocarbons.

5. The method in accordance with claim 4, wherein the second fluid comprises water.

6. The method in accordance with claim 5, further comprising injecting a fluid including a mixture of expandable particles and porous particles.

7. The method in accordance with claim 6, wherein the porous particles are selected from the group consisting of at least one of macroporous silica, macroporous carbon, macroporous polymers, volcanic rocks, pumice, diatomite, zeolites, sintered ceramic materials and sintered metallic materials.

8. The method in accordance with claim 7, further comprising injecting a mixture of expandable and non-porous particles.

9. The method in accordance with claim 8, wherein the non-porous particles are selected from the group consisting of at least one of glass spheres, polymer spheres, and mineral particles.

10. The method in accordance with claim 1, further comprising injecting the first and second fluids to the filter element through a wellbore.

11. The method in accordance with claim 1, wherein the filtering element is a casing and the openings are perforations, slots, or a combination thereof.

12. The method in accordance with claim 11, further comprising setting one or more packer elements sealingly around the casing.

13. The method in accordance with claim 12, wherein the filtering element includes another filtering element disposed outside the casing.

14. A method for stabilizing an annulus at a production or injection zone in an underground well, the method comprising:

providing in an annulus of the well to be stabilized a filtering element with openings, wherein each opening of the filter element has a size, and wherein the filtering element comprises a casing with perforations therein;

injecting through the openings of the filtering element a first fluid that is supplied via a fluid carrying string disposed within the casing, the first fluid including expandable particles that, when in a non-expanded state, have a size smaller than the size of the openings of the filtering element;

injecting through the openings of the filtering element via the fluid carrying string a second fluid, the second fluid being configured to react with the expandable particles in such a way that the expandable particles are expanded to a size larger than the size of the openings in the filtering element, whereby the expanded expandable particles and the filtering element form a filter at the production or injection zone in the well.

15. The method in accordance with claim 14, further comprising providing a sand screen outside the casing.

16. The method in accordance with claim 15, further comprising setting a pair of packer elements around the casing wherein the sand screen is positioned between the pair of packers.

17. The method in accordance with claim 15 wherein the first fluid further includes porous particles selected from the group consisting of at least one of macroporous silica, macroporous carbon, macroporous polymers, volcanic rocks, pumice, diatomite, zeolites, sintered ceramic materials, and sintered metallic materials.

18. The method in accordance with claim 15 wherein the first fluid further includes non-porous particles selected from group consisting of at least one of glass spheres, polymer spheres, and mineral particles.

* * * * *